US010386781B2

(12) United States Patent
Shima

(10) Patent No.: US 10,386,781 B2
(45) Date of Patent: Aug. 20, 2019

(54) IMAGE FORMING APPARATUS COMPRISING INTERMEDIATE TRANSFER UNIT MOVABLY SUPPORTED ON MAIN BODY COVER

(71) Applicant: CANON KABUSHIKI KAISHA, Tokyo (JP)

(72) Inventor: Toshihide Shima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/114,347

(22) Filed: Aug. 28, 2018

(65) Prior Publication Data

US 2019/0064728 A1 Feb. 28, 2019

(30) Foreign Application Priority Data

Aug. 30, 2017 (JP) ..... 2017-166165

(51) Int. Cl.
*G03G 15/16* (2006.01)
*G03G 21/16* (2006.01)

(52) U.S. Cl.
CPC ..... *G03G 21/1638* (2013.01); *G03G 15/161* (2013.01); *G03G 15/165* (2013.01); *G03G 15/1685* (2013.01); *G03G 21/168* (2013.01); *G03G 21/1633* (2013.01); *G03G 21/1647* (2013.01); *G03G 2215/00544* (2013.01); *G03G 2221/1642* (2013.01); *G03G 2221/1654* (2013.01)

(58) Field of Classification Search
CPC ..... G03G 21/1633; G03G 21/168; G03G 21/1647; G03G 21/1638; G03G 15/165
USPC ..... 399/308, 124, 116, 121
See application file for complete search history.

(56) References Cited

U.S. PATENT DOCUMENTS 7,844,199 B2 * 11/2010 Suzuki ..... G03G 21/168 399/121
8,571,439 B2 * 10/2013 Nakazawa ..... G03G 15/161 399/110
8,971,762 B2 * 3/2015 Fukase ..... G03G 15/16 399/121
9,323,212 B2 * 4/2016 Fukase ..... G03G 21/1633
(Continued)

FOREIGN PATENT DOCUMENTS

JP 2004-012674 A 1/2004
JP 2005-070218 A 3/2005
(Continued)

*Primary Examiner* — Walter L Lindsay, Jr.
*Assistant Examiner* — Arlene Heredia
(74) *Attorney, Agent, or Firm* — Venable LLP

(57) ABSTRACT

An image forming apparatus includes: a cover configured to be pivotal between a closed position and an open position to open an opening portion through which an intermediate transfer unit is removable, wherein when the cover is moved from an intermediate position to the open position, a secondary transfer unit is changed by using a self-weight of the secondary transfer unit from a first relative position to a second relative position, and wherein when the cover is located in the open position and the intermediate transfer unit is supported in a first position by a guiding portion, a secondary transfer unit interferes with the intermediate transfer unit if located in the first relative position, but does not interfere with the intermediate transfer unit if located in the second relative position.

10 Claims, 11 Drawing Sheets

(56) References Cited

U.S. PATENT DOCUMENTS

| | | | | |
|---|---|---|---|---|
| 9,746,821 | B2 * | 8/2017 | Iida | G03G 21/168 |
| 2006/0062593 | A1 | 3/2006 | Takahashi | |
| 2014/0140727 | A1 | 5/2014 | Shimoi | |

FOREIGN PATENT DOCUMENTS

| | | | |
|---|---|---|---|
| JP | 2006-084957 | A | 3/2006 |
| JP | 2007-121845 | A | 5/2007 |
| JP | 2009-282475 | A | 12/2009 |
| JP | 2014-102418 | A | 6/2014 |

* cited by examiner

IMAGE FORMING APPARATUS COMPRISING INTERMEDIATE TRANSFER UNIT MOVABLY SUPPORTED ON MAIN BODY COVER

BACKGROUND OF THE INVENTION

Field of the Invention

The present invention relates to an electrophotographic or electrostatic-recording image forming apparatus, and more particularly, to an image forming apparatus configured to retract transfer rollers or pressure rollers when a cover provided on a main body is opened.

Description of the Related Art

Conventionally, as an electrophotographic image forming apparatus, an image forming apparatus is widely known which transfers toner images of different colors one on top of another to an intermediate transfer belt and transfers the toner images carried by the intermediate transfer belt onto a sheet which is a recording medium all at once by transfer rollers. Some image forming apparatuses of this type have a cover which can be opened and closed in lateral part of a main body. Image forming apparatuses are known which make it easy for a user to perform jam clearance by providing, for example, a mechanism for retracting the transfer rollers from the intermediate transfer belt when the cover is opened. As an example of such an image forming apparatus, an image forming apparatus intended to reduce the user's operating force required to open the cover has been developed (Japanese Patent Application Laid-Open No. 2014-102418). In the image forming apparatus, a secondary transfer unit having transfer rollers is supported by the cover, and when the secondary transfer unit is rotated in such a direction as to close the cover, a pivot center of the secondary transfer unit gets engaged with the main body. With this image forming apparatus, after the pivot center of the secondary transfer unit is engaged with the main body, the secondary transfer unit rotates around the pivot center as the cover is closed and the transfer rollers are locked by being pressed against the intermediate transfer belt. This widens a sheet conveyance route and thereby allows jam clearance to be eased.

Here, to abut the transfer rollers against the intermediate transfer belt, the pivot center of the secondary transfer unit is designed to be engaged with the main body, and therefore the secondary transfer unit protrudes toward the main body from the cover. Therefore, a biasing spring configured to bias the secondary transfer unit so as to protrude toward the main body from the cover is provided between the cover and secondary transfer unit. Consequently, the secondary transfer unit is biased in a state of protruding toward the main body from the cover such that the pivot center of the secondary transfer unit and the main body can be engaged with each other easily when the cover is closed.

However, with the above-mentioned image forming apparatus of the Japanese Patent Application Laid-Open No. 2014-102418, because the secondary transfer unit always protrudes greatly from the cover, there can be a problem such as follows when the cover is downsized. That is, when an intermediate transfer unit including the intermediate transfer belt is removed from the main body by opening the cover, the intermediate transfer unit being pulled out might interfere with the secondary transfer unit protruding upward from the opened cover. To avoid interference between the intermediate transfer unit and secondary transfer unit, it is conceivable to establish a rotation center of the cover in lower part of the main body, lowering a position of the opened cover and thereby lowering a protruding position of the secondary transfer unit. However, if the rotation center of the cover is established at a position shifted greatly downward in the lower part of the main body, the cover will grow in size and spread sideways greatly from the main body when the cover is opened, creating a problem of large installation space.

SUMMARY OF THE INVENTION

The present invention provides an image forming apparatus configured such that an intermediate transfer unit is attached and detached by opening a cover supporting a secondary transfer unit and configured to suppress increases in the size of the cover while securing a work space above the cover when the cover is opened.

An image forming apparatus according to one embodiment of the present invention, comprises:

a main body;

an opening portion provided in a side surface of the main body;

a cover pivotally provided on the main body and configured to be pivotal between a closed position in which the opening portion is closed and an open position in which the opening portion is opened, an upper part of the cover being openable outward and closable around a rotary shaft provided in a lower part of the cover;

an intermediate transfer unit provided in the main body so as to be detachable and mountable through the opening portion and provided with an intermediate transfer belt to which a toner image is transferred;

a secondary transfer unit movably supported with respect to the cover and provided with a transfer member configured to transfer the toner image transferred to the intermediate transfer belt to a recording material;

a guiding portion provided in the main body and configured to guide the intermediate transfer unit, the guiding portion being configured to guide the intermediate transfer unit from a first position in which the intermediate transfer unit becomes removable from the main body to a second position in which the intermediate transfer unit is mounted in the main body, the guiding portion being configured to support the intermediate transfer unit in the first position;

a first engaging portion provided on the secondary transfer unit; and a second engaging portion provided on the cover so as to be engageable with the first engaging portion and configured to limit movement of the secondary transfer unit relative to the cover to a predetermined range by being engaged with the first engaging portion, wherein when the cover is moved from an intermediate position between the closed position and the open position to the open position, a relative position of the secondary transfer unit with respect to the cover is changed by using a self-weight of the secondary transfer unit from a first relative position to a second relative position, and wherein when the cover is located in the open position and the intermediate transfer unit is supported in the first position by the guiding portion, the secondary transfer unit interferes with the intermediate transfer unit if located in the first relative position, but does not interfere with the intermediate transfer unit if located in the second relative position.

Further features of the present invention will become apparent from the following description of exemplary embodiments with reference to the attached drawings.

DESCRIPTION OF THE EMBODIMENTS

First Embodiment

A first embodiment will be described in detail below with reference to FIGS. 1 to 10. In the present embodiment, a tandem full-color printer is described as an example of an image forming apparatus 1. However, the present invention is not limited to tandem printers, and is applicable to other types of printers. Also, the present invention is not limited to being full color, and may be black-and-white or mono-color. Alternatively, by adding necessary equipment, accessories and a casing structure, the present invention can be embodied in various applications such as printers, various printing machines, fax machines, and multi-functional peripherals. Regarding a developer, a two-component developer made up of a nonmagnetic toner and magnetic carrier is used in the present embodiment.

Figure 1:
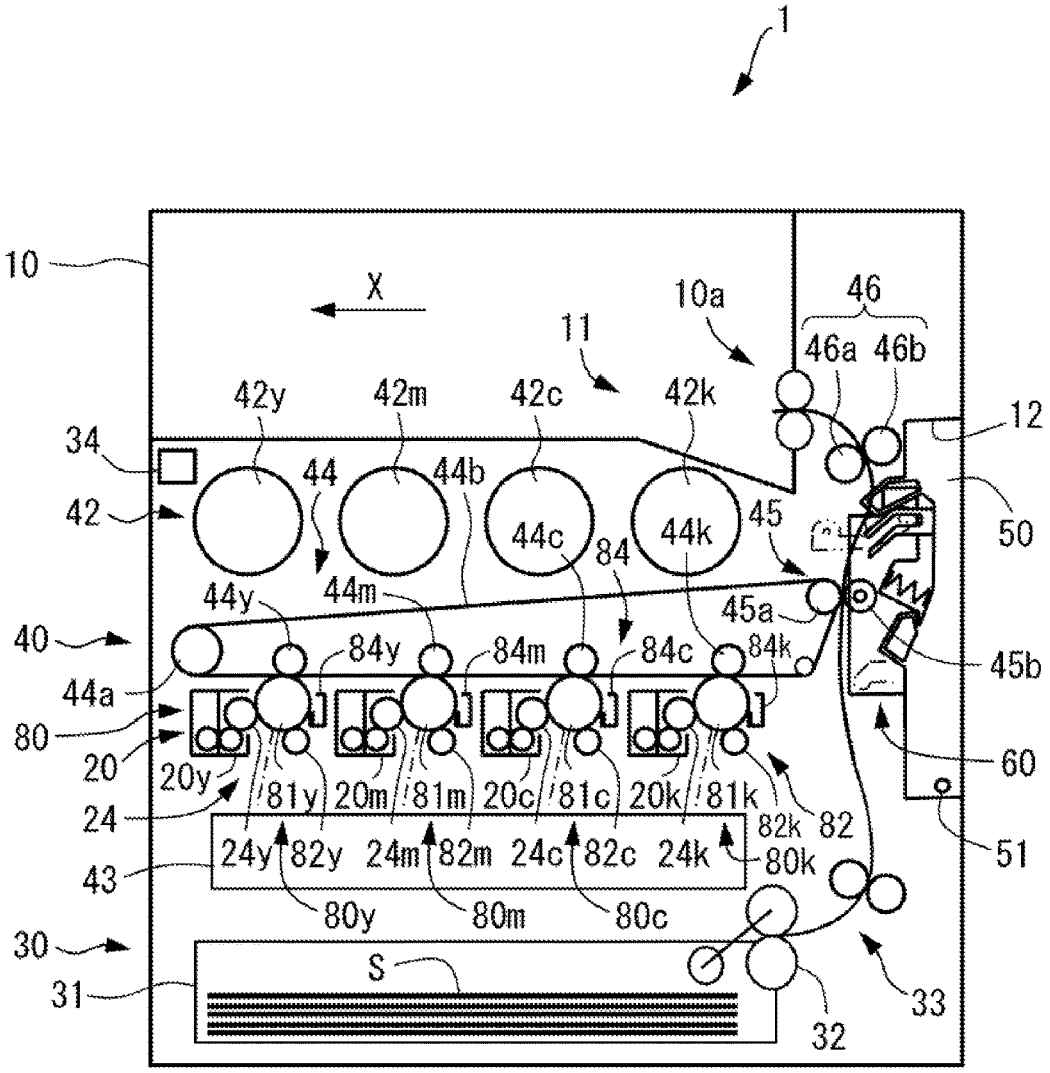
FIG. 1 is a sectional view showing a schematic configuration of an image forming apparatus according to a first embodiment.

As shown in FIG. 1, the image forming apparatus 1 includes a main body 10 as a casing. The main body 10 includes an image reading portion (not shown), a sheet feeding portion 30, an image forming portion 40, a sheet conveying portion 33, a sheet discharging portion 11 and a controlling portion 34. Note that a sheet S which is a recording material is used to form toner images thereon and concrete examples of the sheet S include plain paper, a resin sheet which is a substitute for plain paper, cardboard, and a sheet for an overhead projector.

In that lateral part of the main body 10 which is closer to a secondary transfer portion 45 described later, an opening portion 12 is provided, being formed by communicating the inside and outside of the main body 10. A cover 50 is provided pivotally between a closed position (see FIG. 1) in which the opening portion 12 is closed and an open position (see FIG. 7) in which the opening portion 12 is open. The cover 50 is an exterior member making up part of an exterior of the main body 10. A rotary shaft 51 is provided horizontally in lower part of the cover 50 and the cover 50 is a door member whose upper part can be opened outward of the main body 10 around the rotary shaft 51. The sheet feeding portion 30, which is placed in lower part of the main body 10 and provided with a sheet cassette 31 configured to hold the sheets S loaded therein as well as with a feed roller 32, feeds the sheets S to the image forming portion 40.

The image forming portion 40 includes image forming units 80, toner hoppers (not shown), toner containers 42, a laser scanner 43, an intermediate transfer unit 44, a secondary transfer portion 45 and a fixing apparatus 46. The image forming portion 40 can form images on the sheets S based on image information. Note that the image forming apparatus 1 according to the present embodiment supports full-color and includes image forming units 80*y*, 80*m*, 80*c* and 80*k* all having a similar configuration and provided for four colors of yellow (y), magenta (m), cyan (c) and black (k), respectively. Similarly, toner containers 42*y*, 42*m*, 42*c* and 42*k* all having a similar configuration are provided for the four colors of yellow (y), magenta (m), cyan (c) and black (k), respectively. Therefore, in FIG. 1, components belonging to a same group and corresponding to the four colors are denoted by a same symbol subscripted by color identifiers, but may be denoted only by the symbol without color identifiers in the specification.

The toner containers 42 are bottles, for example, cylindrical in shape, configured to hold toners, and placed above the respective image forming units 80 by being coupled together via the toner hoppers. The laser scanner 43 exposes surfaces of photosensitive drums 81 charged by charging rollers 82 and thereby forms electrostatic latent images on the surfaces of the photosensitive drums 81.

The image forming units 80 include four image forming units 80*y*, 80*m*, 80*c* and 80*k* for use to form toner images of four colors. Each of the image forming units 80 includes the photosensitive drum 81 configured to move by carrying a toner image, the charging roller 82, a developing apparatus 20, and a cleaning blade 84. Also, the photosensitive drums 81 all having a similar configuration are provided for the four colors of yellow (y), magenta (m), cyan (c) and black (k), respectively, and so are the charging rollers 82, the developing apparatuses 20, the cleaning blades 84, and after-mentioned developing sleeves 24.

Each of the photosensitive drums 81 includes a photosensitive layer formed on a circumferential surface of an aluminum cylinder so as to have negatively charged polarity and rotates at a predetermined process speed (circumferential speed). The charging roller 82 is placed in contact with the surface of the photosensitive drum 81 and charges the surface of the photosensitive drum 81, for example, to uniform negative dark section potential. An electrostatic image is formed on the changed surface of the photosensitive drum 81 by the laser scanner 43 based on image information. The photosensitive drum 81 performs orbital movement by carrying the formed electrostatic image, which is then developed by the developing apparatus 20.

The developed toner image is primarily transferred onto an intermediate transfer belt 44*b* described later. After the primary transfer, the photosensitive drum 81 has its surface electrostatically neutralized by a pre-exposure portion (not shown). The cleaning blade 84, which is placed in contact with the surface of the photosensitive drum 81, cleans residues such as excess toner remaining on the surface of the photosensitive drum 81 after the primary transfer.

Figure 7:
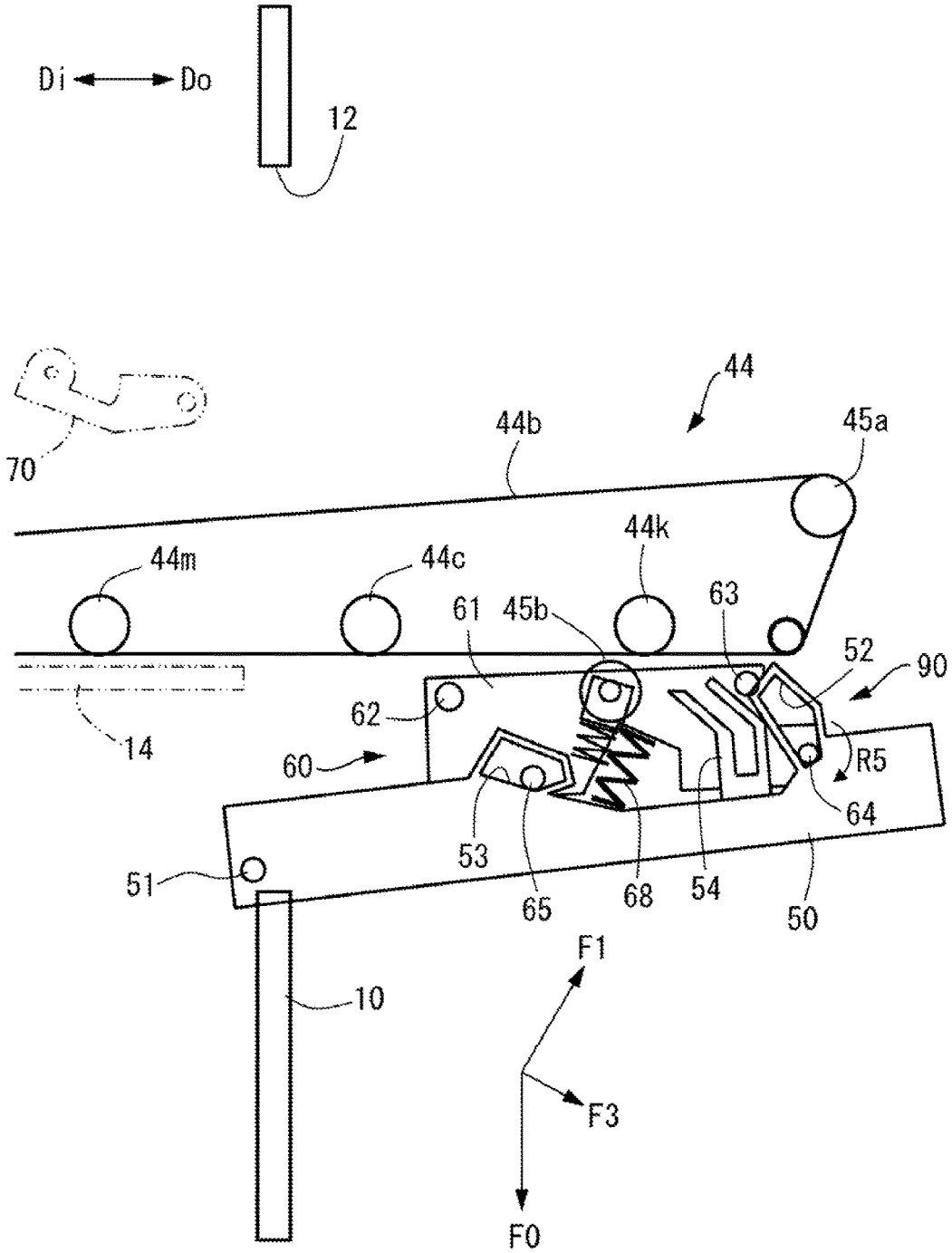
FIG. 7 is a sectional view showing a schematic configuration with the cover according to the first embodiment opened to a second inclined position, which is a maximum open position and with the secondary transfer unit located at a second relative position.

The intermediate transfer unit 44 is placed above the image forming units 80*y*, 80*m*, 80*c* and 80*k*. The intermediate transfer unit 44 includes plural rollers such as a driving roller 44*a*, a driven roller, and primary transfer rollers 44*y*, 44*m*, 44*c* and 44*k* as well as the intermediate transfer belt 44*b* looped over the rollers. The primary transfer rollers 44*y*, 44*m*, 44*c* and 44*k* are placed facing photosensitive drums 81*y*, 81*m*, 81*c* and 81*k*, respectively, and abut the intermediate transfer belt 44*b*. As shown in FIG. 7, the intermediate transfer unit 44 is detachably attached to the main body 10 as a unit including the intermediate transfer belt 44*b* and plural rollers provided on the inner peripheral side of the intermediate transfer belt 44*b*. That is, the intermediate transfer unit 44 is detachably mounted in the main body 10 and is configured to be detachable from the main body 10 through the opening portion 12 when the cover 50 is located in the open position. According to the present embodiment, a guiding rail (guiding portion) 14 is provided in the main body 10. The guiding rail 14, which is provided in the main body 10, can guide the intermediate transfer unit 44 when the intermediate transfer unit 44 is attached or detached. Attach/detach operation of the intermediate transfer unit 44 will be described later.

As shown in FIG. 1, positive transfer bias is applied to the intermediate transfer belt 44*b* by the primary transfer rollers 44*y*, 44*m*, 44*c* and 44*k*. Consequently, negatively charged toner images on the respective photosensitive drums 81*y*, 81*m*, 81*c* and 81 are transferred one on top of another to the intermediate transfer belt 44*b*. Then, the intermediate transfer belt 44*b* moves by transferring the toner images obtained by developing electrostatic images on surfaces of the photosensitive drums 81*y*, 81*m*, 81*c* and 81*k*.

The secondary transfer portion 45 includes a secondary transfer inner roller 45*a* configured to support an inner side surface of the intermediate transfer belt 44*b* and a secondary transfer outer roller 45*b* configured to abut an outer side surface of the intermediate transfer belt 44*b*. The secondary transfer inner roller 45*a* is detachably attached to the main body 10 as part of the intermediate transfer unit 44, rotatably supported on the main body 10, and grounded. The secondary transfer outer roller 45*b* is connected with a secondary transfer bias supply configured to apply secondary transfer bias to the secondary transfer outer roller 45*b*. The secondary transfer outer roller 45*b* is rotatably supported on the cover 50 and abutted against the secondary transfer inner roller 45*a* via the intermediate transfer belt 44*b*, thereby forming a secondary transfer nip portion (nip portion) between the secondary transfer outer roller 45*b* and intermediate transfer belt 44*b*. Then, when secondary transfer bias is applied, the toner images primarily transferred onto the intermediate transfer belt 44*b* is secondarily transferred onto the sheet S in the secondary transfer portion 45. The secondary transfer outer roller 45*b* is provided in an after-mentioned secondary transfer unit (cover-side unit) 60, which is provided on the cover 50 and supported in such a way as to be able to move relative to the cover 50 when the cover 50 is opened and closed. Detailed configurations of the cover 50 and secondary transfer unit 60 will be described later.

The fixing apparatus 46 includes a fixing roller 46*a* and a pressure roller (nip forming roller) 46*b*. The fixing roller 46*a* is provided in the main body 10 and configured to heat an image surface of the sheet S. The pressure roller 46*b* comes into pressure contact with the fixing roller 46*a* and thereby forms a nip portion for the sheet S. The sheet S is conveyed by being nipped between the fixing roller 46*a* and pressure roller 46*b*, and consequently the toner images transferred onto the sheet S are heated and pressed to get fixed on the sheet S. The sheet conveying portion 33 conveys the sheet S fed by the sheet feeding portion 30, from the image forming portion 40 to the sheet discharging portion 11. The sheet discharging portion 11 is loaded with the sheets S ejected from the sheet conveying portion 33 in the direction of arrow X through an outlet port 10*a*.

The controlling portion 34 is made up of a computer and includes, for example, a CPU, a ROM which stores programs configured to control various components, a RAM configured to temporarily store data, and an input-output circuit configured to input and output data from/to the outside. The CPU is a microprocessor configured to perform overall control of the image forming apparatus 1 and forms the nucleus of a system controller. The CPU is connected with the image reading portion, sheet feeding portion 30, image forming portion 40, sheet conveying portion 33, and operating portion via the input-output circuit, exchanges signals with these components, and controls operation of these components.

Next, image forming operation performed by the image forming apparatus 1 configured as described above will be described.

When image forming operation is started, first the photosensitive drums 81 rotate and their surfaces are charged by the charging roller 82. Then, a laser beam is emitted to the photosensitive drums 81 by the laser scanner 43 based on the image information, forming electrostatic latent images on the surfaces of the photosensitive drums 81. When toner attaches to the electrostatic latent images, the electrostatic latent images are developed and visualized as toner images and transferred onto the intermediate transfer belt 44*b*.

On the other hand, concurrently with the toner image forming operation, the sheet feeding portion comes into operation, and the sheet S is conveyed to the secondary transfer portion 45 in timing with the toner images on the intermediate transfer belt 44*b*. Also, the images are transferred from the intermediate transfer belt 44*b* to the sheet S, which is then conveyed to the fixing apparatus 46, and the unfixed toner images are fixed on the surface of the sheet S by being heated and pressed there. Then, the sheet S is ejected through the outlet port 10*a* and loaded onto the sheet discharging portion 11.

Next, the cover 50 and secondary transfer unit 60 will be described in detail with reference to FIGS. 2 to 9C. The cover 50 is rotatable on the rotary shaft 51 and is provided on the opening portion 12 in such a way as to be able to be opened and closed, the opening portion 12 being formed in that lateral part of the main body 10 which is closer to the secondary transfer portion 45. Here, according to the present embodiment, with respect to an open and close direction of the cover 50, a horizontal direction facing an inner side of the main body 10 will be designated as an inward direction Di and a horizontal direction facing an outer side will be designated as an outward direction Do.

The cover 50 is located substantially horizontally (approximately 75 degrees) when opened (see FIG. 7). In lateral part in the inward direction Di, the cover 50 includes a first restraining portion (restraining portion) 52 placed on a side far from the rotary shaft 51, a second restraining portion (restraining portion) 53 placed on a side closer to the rotary shaft 51 than the first restraining portion 52, and a guide member (guide portion) 54. Each of the restraining portions 52 and 53 is made up of a hole inclined so as to be lower in the inward direction Di and higher in the outward direction Do when the cover 50 is located in the closed position (see FIG. 2).

A lock lever (lock lever portion) 70 is provided on the main body 10 pivotally with respect to the main body 10. The lock lever 70 includes a rotary shaft 71 rotatably mounted on the main body 10, an engaging pin 72 provided in a tip portion, and a locking portion 73 shaped like a step and provided in an approximate central portion. The guide member 54 includes a guiding groove configured to open in the inward direction Di of the main body 10 by extending in a substantially horizontal direction and raised in the outward direction Do. The guide member 54 can guide the lock lever 70 by engaging the engaging pin 72 of the lock lever 70 with the guiding groove and guide the lock lever 70 to a lock position and an unlock position through rotation by guiding the engaging pin 72 along with movement of the cover 50. When the cover 50 is closed, the engaging pin 72 is lifted and the locking portion 73 is engaged with an after-mentioned locating pin 63 of the secondary transfer unit 60, fixing a support member 61 to the main body 10.

According to the present embodiment, the cover 50 can be placed (fixed) in a first inclined position (see FIG. 5) in which an engaging groove 13 and rotational engaging portion 62 come close to each other without getting engaged with each other and a second inclined position (open position; see FIG. 7) sloped more greatly with respect to a vertical direction than is the first inclined position. The first inclined position is located between the closed position and open position. When the cover 50 is located in the first inclined position, jam clearance is enabled. When the cover 50 is located in the second inclined position, the secondary transfer unit 60 can be attached and detached through the opening portion 12.

The secondary transfer unit 60 includes the support member 61 movably supported with respect to the cover 50, the rotational engaging portion (fourth engaging portion) 62, the locating pin 63, a first engaging pin (restraining portion) 64, and a second engaging pin (restraining portion) 65.

The rotational engaging portion 62 can get engaged with the engaging groove (third engaging portion) 13 provided in the main body 10. The engaging groove 13 includes a rotation center portion 13*a* depressed downward on an inner side of the main body 10 in the horizontal direction. Along with the action of closing the cover 50, the rotational engaging portion 62 is guided by being engaged with the engaging groove 13 and is engaged with the rotation center portion 13*a*, thereby making the secondary transfer unit 60 rotatable around the rotation center portion 13*a*. Also, when the cover 50 is located in the closed position (see FIG. 2), the rotational engaging portion 62 is placed on the side of the main body 10 in lower part of the support member 61. Consequently, in closing the cover 50, the rotational engaging portion 62 can get into the main body 10 earlier than when placed elsewhere, and get engaged with the engaging groove 13. That is, the rotational engaging portion 62 is provided in such a way as to be able to get engaged with the engaging groove 13 in lower part of the support member 61, is engaged with the engaging groove 13 when the cover 50 is closed to rotatably support the support member 61 as a result of the engagement, and is spaced away from the engaging groove 13 when the cover 50 is opened. Also, when the engaging groove 13 and rotational engaging portion 62 are engaged with each other, the support member 61 can rotate its upper part around the rotational engaging portion 62 toward the secondary transfer inner roller 45*a*.

When the cover 50 is located in the closed position (see FIG. 2), the locating pin 63 is placed on the side of the main body 10 in upper part of the support member 61. The locating pin 63 can be locked to the locking portion 73 of the lock lever 70, and the secondary transfer unit 60 is locked to the main body 10 as a result of the engagement.

The first engaging pin 64 is provided in such a way as to be able to move inside the first restraining portion 52 by being engaged with the first restraining portion 52. Similarly, the second engaging pin 65 is provided in such a way as to be able to move inside the second restraining portion 53 by being engaged with the second restraining portion 53. That is, the first engaging pin 64 and first restraining portion 52 as well as the second engaging pin 65 and second restraining portion 53 limit movement of the support member 61 with respect to the cover 50 in a circumferential direction around the rotary shaft 51 to a predetermined range.

Here, the secondary transfer unit 60 is supported in such a way as to be able to move relative to the cover 50. According to the present embodiment, when the cover 50 is located between the closed position and open position, i.e., in the first inclined position, the relative position of the secondary transfer unit 60 with respect to the cover 50 is placed at a first relative position. Also, when the cover 50 is located in the open position, i.e., in the second inclined position, the relative position of the secondary transfer unit 60 with respect to the cover 50 is placed at a second relative position. Also, when the cover 50 is located in the closed position, the relative position of the secondary transfer unit 60 with respect to the cover 50 is located at a third relative position.

Also, the secondary transfer outer roller 45*b* is rotatably supported on the secondary transfer unit 60 in such a way as to be biased toward the secondary transfer inner roller 45*a* when the cover 50 is in the closed position. Here, the secondary transfer outer roller 45*b* is rotatably supported by a bearing 66, which is slidably provided on the support member 61 and biased toward the secondary transfer inner roller 45*a* from the support member 61 by a biasing spring (biasing portion) 67 made up of a compression coil spring. That is, the biasing spring 67 is placed between the secondary transfer outer roller 45*b* and support member 61 and is able to bias the secondary transfer outer roller 45*b* from the support member 61 toward the secondary transfer inner roller 45*a*. Also, the biasing spring 67 is pressed when the secondary transfer inner roller 45*a* and secondary transfer outer roller 45*b* abut each other, and applies a biasing force between the secondary transfer outer roller 45*b* and secondary transfer inner roller 45*a*.

A biasing spring (biasing unit) 68 made up of a compression coil spring is provided between the cover 50 and support member 61. According to the present embodiment, a biasing direction of the biasing spring 68 is oriented such that when the cover 50 is placed in the closed position (see FIG. 2), the direction facing the inner side of the main body 10 will coincide with an obliquely upward direction. Here, when the cover 50 is located in the second inclined position (see FIG. 7), the relative position of the secondary transfer unit 60 with respect to the cover 50 is moved to the second relative position by the resultant force of the self-weight of the secondary transfer unit 60 and the biasing force of the biasing spring 68. Also, when the cover 50 is located in the first inclined position (see FIG. 5), the relative position of the secondary transfer unit 60 with respect to the cover 50 is moved to the first relative position by the resultant force of the self-weight of the secondary transfer unit 60 and the biasing force of the biasing spring 68. In this way, the magnitude of the biasing force of the biasing spring 68 is such that when the cover 50 moves from the first inclined position (see FIG. 5) to the second inclined position (see FIG. 7), the relative position of the support member 61 with respect to the cover 50 will change under self-weight of the support member 61 from the first relative position (see FIG. 5) to the second relative position (see FIG. 7) on the side of the cover 50.

In this way, through its opening and closing operation, the cover 50 acts on the secondary transfer unit 60 such that the secondary transfer outer roller 45*b* will be abutted against, or spaced away from, the intermediate transfer belt 44*b*. Note that the lock levers 70, locating pins 63, guide members 54, engaging grooves 13, rotational engaging portions 62, restraining portions 52, restraining portions 53, biasing springs 68, engaging pins 64 and engaging pins 65 are provided in pairs on the near side and far side along a width direction orthogonal to a sheet conveyance direction.

Here, the image forming apparatus 1 according to the present embodiment is provided with a switching portion 90 configured to switch the position of the secondary transfer unit 60 with respect to the cover 50. According to the present embodiment, the switching portion 90 is made up of the first engaging pin 64 and first restraining portion 52, the second engaging pin 65 and second restraining portion 53, and the biasing springs 68. The switching portion 90 switches the relative position of the secondary transfer unit 60 with respect to the cover 50 between the first relative position and second relative position.

Figure 5:
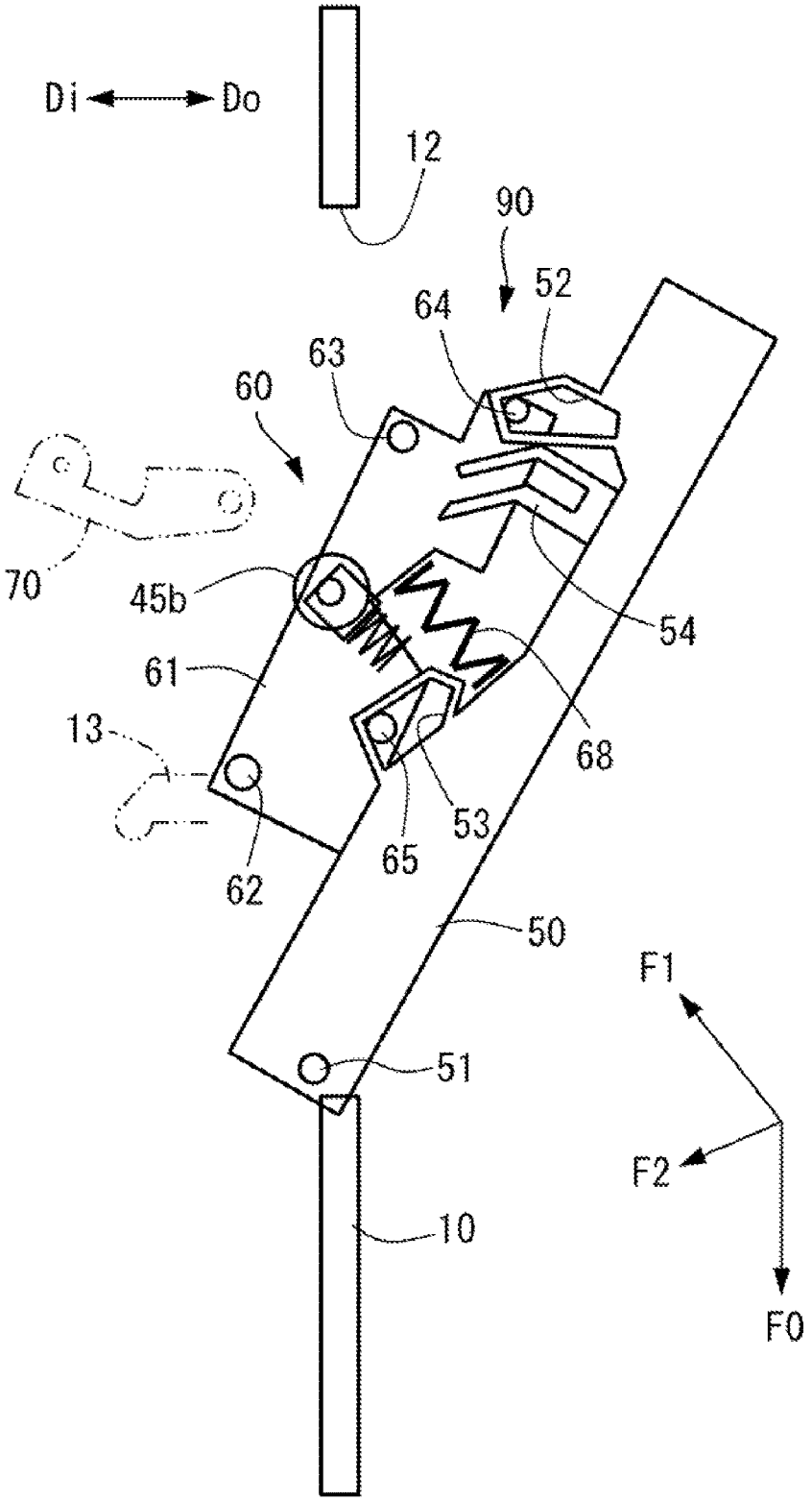
FIG. 5 is a sectional view showing a schematic configuration with the cover according to the first embodiment opened to a first inclined position and with the secondary transfer unit located at a first relative position.

As shown in FIG. 5, the first relative position is a position at which the secondary transfer unit 60 protrudes toward the main body 10 from the cover 50 when the cover 50 is located in the first inclined position. In so doing, if F0 denotes a force of gravity caused by the self-weight of the secondary transfer unit 60 and F1 denotes the biasing force of the biasing spring 68, a resultant force F2 faces obliquely downward in the inward direction Di. By the resultant force of a force of gravity caused by the self-weight of the support member 61 and the biasing force of the biasing spring 68, the support member 61 abuts the first engaging pin 64 against an end portion of the first restraining portion 52 in the inward direction Di and abuts the second engaging pin 65 against end portion of the second restraining portion 53 in the inward direction Di, thereby being fixed by protruding from the cover 50.

As shown in FIG. 7, the second relative position is a position at which the secondary transfer unit 60 is depressed closer to the cover 50 than is the first relative position when the cover 50 is located in the second inclined position. In so doing, if F0 denotes a force of gravity caused by the self-weight of the secondary transfer unit 60 and F1 denotes the biasing force of the biasing spring 68, a resultant force F3 faces obliquely downward in the outward direction Do. By the resultant force of a force of gravity caused by the self-weight of the support member 61 and the biasing force of the biasing spring 68, the support member 61 abuts the first engaging pin 64 against that end portion of the first restraining portion 52 which is located obliquely downward in the outward direction Do and abuts the second engaging pin 65 against a lower end portion of the second restraining portion 53. Consequently, the support member 61 is fixed by being depressed closer to the cover 50.

Figure 8A:
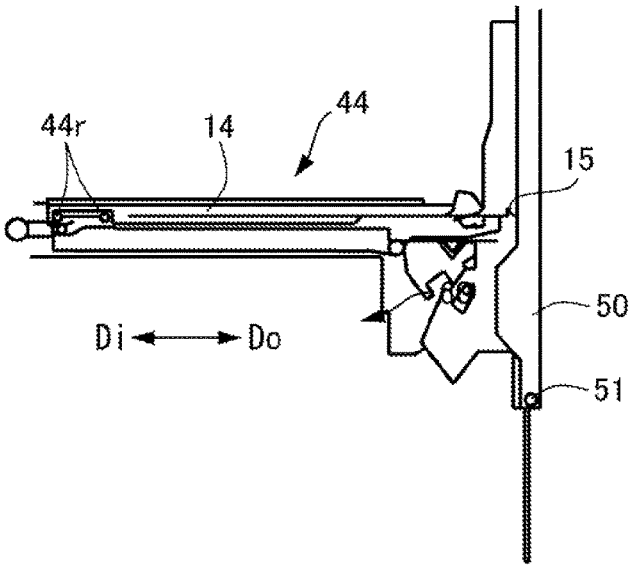
FIG. 8A is a side view showing how the cover is located in a closed position in the operation of pulling out an intermediate transfer unit of the image forming apparatus according to the first embodiment.
Figure 8B:
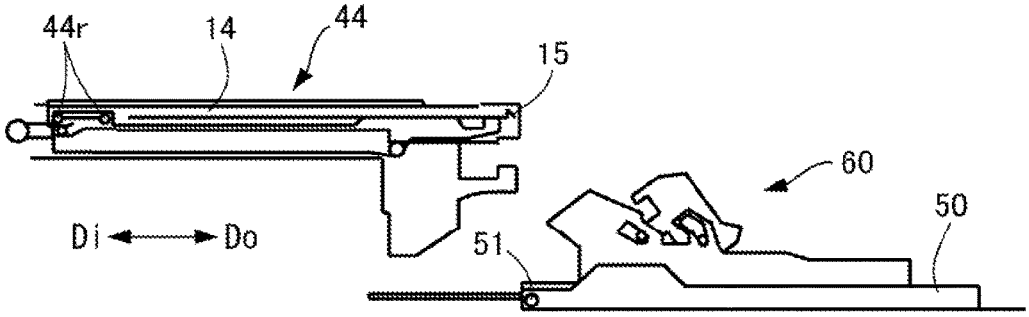
FIG. 8B is a side view showing how the cover is located in an open position in the operation of pulling out the intermediate transfer unit of the image forming apparatus according to the first embodiment.
Figure 8C:
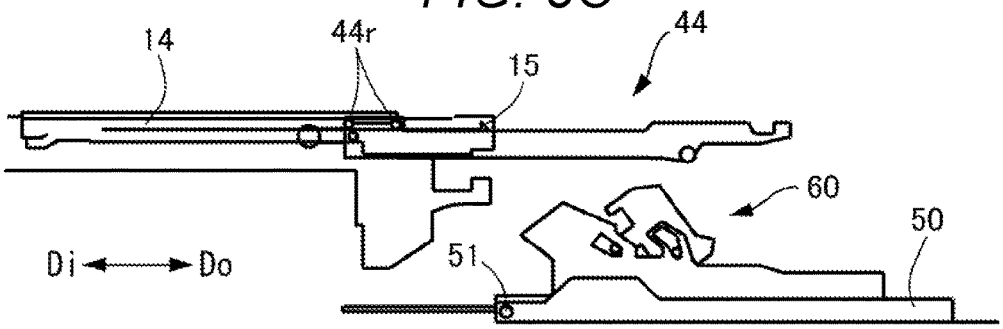
FIG. 8C is a side view showing how the intermediate transfer unit is pulled out halfway in the operation of pulling out the intermediate transfer unit of the image forming apparatus according to the first embodiment.

Now, a guiding structure for attaching and detaching the intermediate transfer unit 44 will be described in detail with reference to FIGS. 8A, 8B, 8C, 9A, 9B and 9C. As shown in FIGS. 8A to 8C, guiding rails 14 are provided in the main body 10. When the cover 50 is located in the second inclined position, the guiding rails 14 can guide the intermediate transfer unit 44 so as to attach and detach the intermediate transfer unit 44 with respect to the main body 10 in the inward direction Di and outward direction Do. Each of the guiding rails 14 has guiding surfaces opposed to each other in an up and down direction in parallel to each other and guides the intermediate transfer unit 44 between the guiding surfaces. The intermediate transfer unit 44 is provided with engaging bosses 44*r* guided by being fitted between the guiding surfaces of the guiding rails 14. A pair of the engaging bosses 44*r* are provided by being spaced away from each other in the inward direction Di and outward direction Do. Note that the guiding rails 14 and engaging bosses 44*r* are provided in pairs on the near side and far side along the width direction orthogonal to the sheet conveyance direction.

Figure 9A:
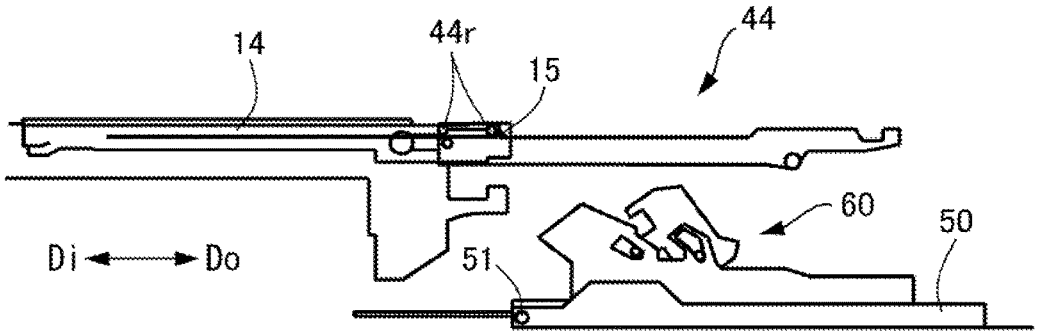
FIG. 9A is a side view showing how the intermediate transfer unit is located in a fully pulled out position in the operation of pulling out the intermediate transfer unit of the image forming apparatus according to the first embodiment.
Figure 9B:
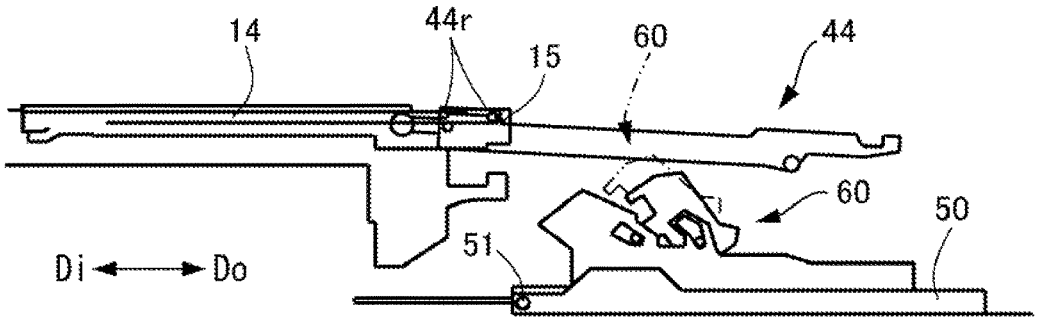
FIG. 9B is a side view showing how the intermediate transfer unit is supported by a support in the operation of pulling out the intermediate transfer unit of the image forming apparatus according to the first embodiment.

A support portion 15 is provided in an end portion of a lower guiding surface of each guiding rail 14 in the outward direction Do, being shaped to slightly protrude upward. As shown in FIG. 9A, when the intermediate transfer unit 44 is being pulled out, the engaging boss 44*r* in the outward direction Do is locked by the support portion 15, once stopping the intermediate transfer unit 44. At this time, if a user loses hold of the intermediate transfer unit 44, the engaging boss 44*r* in the outward direction Do is locked by the support portion 15 as shown in FIG. 9B and the engaging boss 44*r* in the inward direction Di abuts an upper guiding surface of the guiding rail 14. Consequently, even if the user loses hold of the intermediate transfer unit 44, the supported state is maintained.

According to the present embodiment, this state corresponds to a pulled-out position of the intermediate transfer unit 44. That is, when the cover 50 is located in the second inclined position, the support portion 15 supports the intermediate transfer unit 44 pulled out of the main body 10 along the guiding rail 14 to a predetermined pulled-out position.

Suppose, as indicated by imaginary lines in FIG. 9B, the cover 50 is located in the second inclined position and the secondary transfer unit 60 is located at the first relative position, protruding from the cover 50. In this case, the secondary transfer unit 60 might interfere with the intermediate transfer unit 44 located in the pulled-out position, and thereby damage, for example, the intermediate transfer belt 44*b*. Also, when the cover 50 is located in the second inclined position and the secondary transfer unit 60 is located at the third relative position, protruding from the cover 5, the secondary transfer unit 60 might interfere with the intermediate transfer unit 44 located in the pulled-out position. In contrast, according to the present embodiment, when the cover 50 is located in the second inclined position as indicated by solid lines in FIG. 9B, the secondary transfer unit 60 is located at the 54 relative position closer to the cover 50. Therefore, the secondary transfer unit 60 does not interfere with the intermediate transfer unit 44 located in the pulled-out position, and consequently the intermediate transfer unit 44 can be attached and detached without the fear of damaging the intermediate transfer belt 44*b*.

Figure 9C:
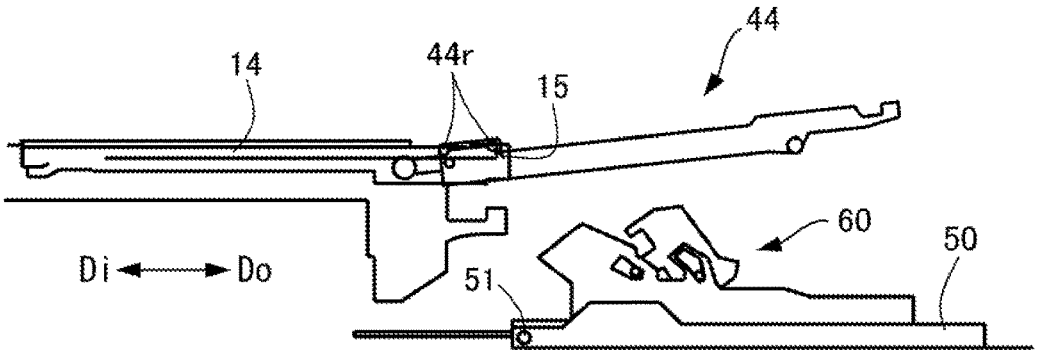
FIG. 9C is a side view showing how the intermediate transfer unit is pulled out of the support in the operation of pulling out the intermediate transfer unit of the image forming apparatus according to the first embodiment.

Also, as shown in FIG. 9C, as the user pulls out the intermediate transfer unit 44 by lifting an end of the intermediate transfer unit 44 in the outward direction Do in the state shown in FIG. 9B, the engaging boss 44*r* in the outward direction Do comes off the support portion 15 upward. This allows the user to pull the intermediate transfer unit 44 completely out of the guiding rail 14, thereby completing removal of the intermediate transfer unit 44. On the other hand, in attaching a new intermediate transfer unit 44, contrary to the removal operation, the intermediate transfer unit 44 can be attach without abutting the engaging boss 44*r* against the support portion 15 if inserted into the guiding rail 14 by being tilted down in the inward direction Di and tilted up slightly in the outward direction Do.

Next, the operation of opening and closing the cover 50 will be described below. Here, both operation in which the user closes the cover 50 and operation in which the user opens the cover 50 will be described.

Figure 3:
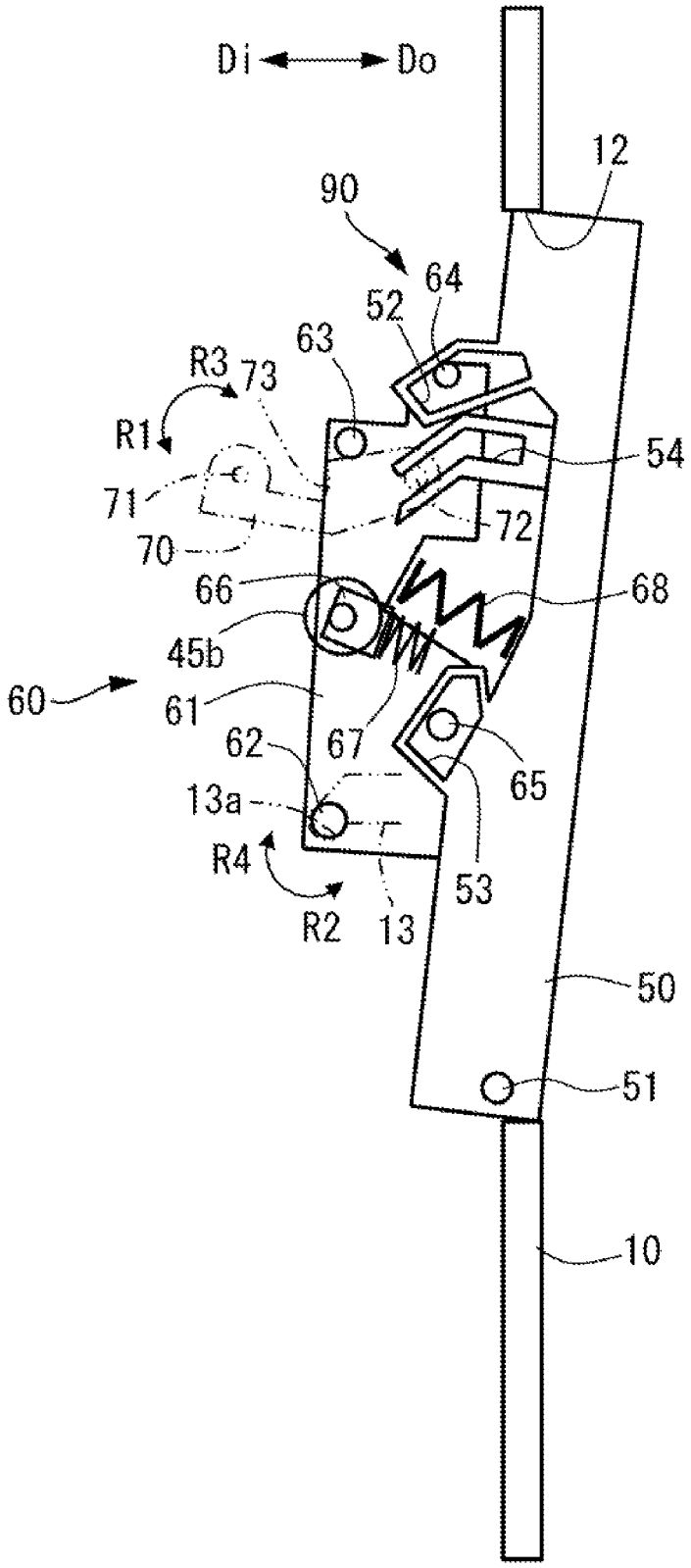
FIG. 3 is a sectional view showing a schematic configuration with the cover and secondary transfer unit according to the first embodiment opened slightly.
Figure 4:
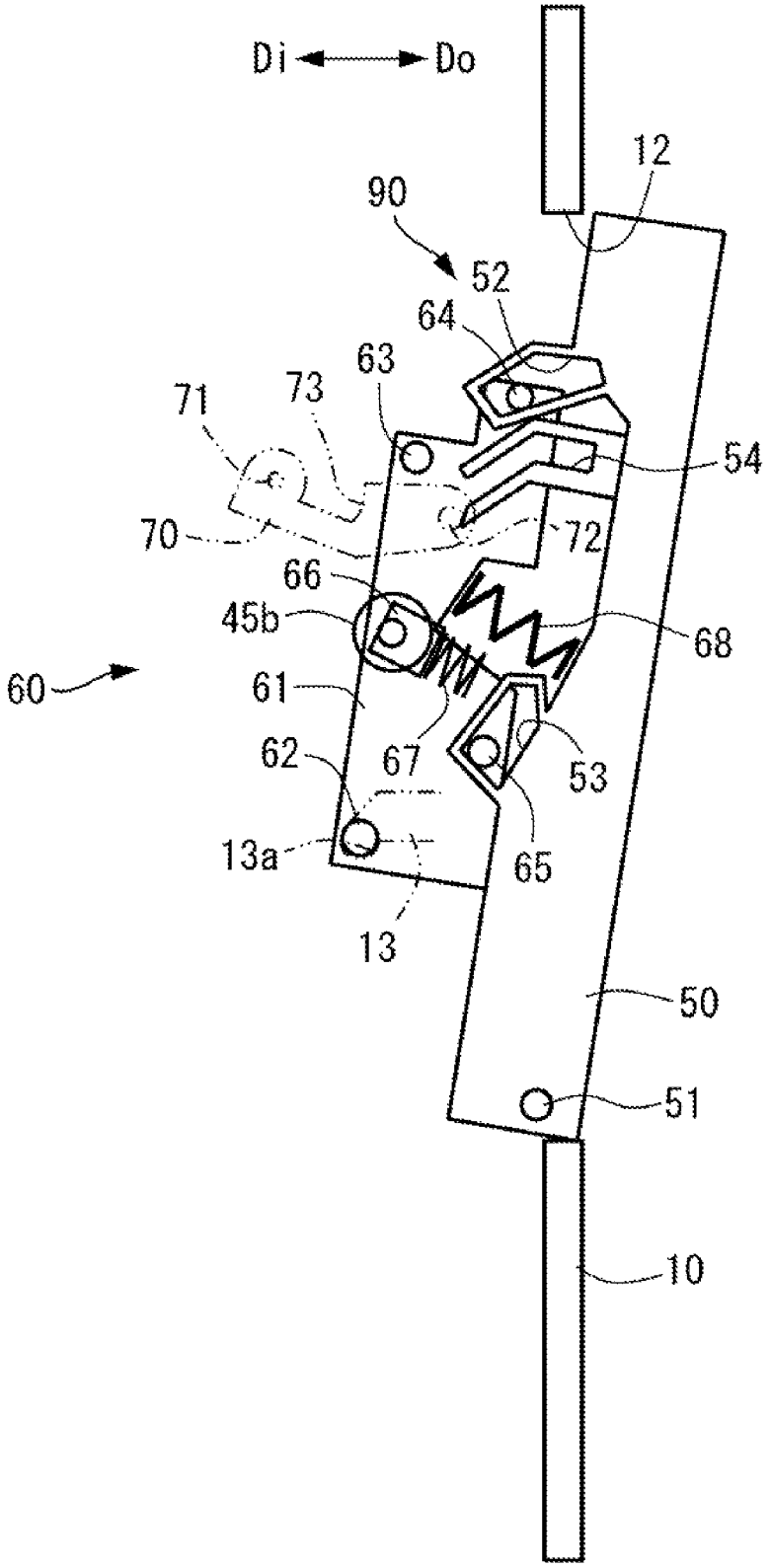
FIG. 4 is a sectional view showing a schematic configuration with the cover and secondary transfer unit according to the first embodiment opened a little more.

In closing the cover 50, as shown in FIG. 5, the user starts turning the cover 50 in a closing direction a direction of closing the cover 50 to get ready to form images. In so doing, the secondary transfer unit 60 is closed together with the cover 50 while being held in such a position as to be biased by the biasing spring 68 in the inward direction Di on the cover 50. As shown in FIG. 4, when the rotational engaging portions 62 of the secondary transfer unit 60 are engaged with the engaging grooves 13, with the 54 engaging pin 65 being pushed by the biasing spring 68 around the rotational engaging portions 62, the secondary transfer unit 60 is closed in the inward direction Di out of phase with the cover 50. As shown in FIG. 3, as the cover 50 continues to be turned further in a direction of being closed, the lock levers 70 mounted on the main body 10 and the guide members 54 mounted on the cover 50 start getting engaged with each other.

The guiding groove of each guide member 54 is shaped as a cam to guide the intermediate transfer unit 44 in contact with the engaging pin 72 of the lock lever 70. Consequently, a rotating force of the cover 50 is transmitted smoothly to the lock lever 70 via the guiding groove of the guide member 54, rotating the lock lever 70 in the direction of arrow R1 around the rotary shaft 71. Also, the locking portion 73 of the lock lever 70 is formed into an arc shape around the rotary shaft 71 of the lock lever 70 and is locked to the locating pin 63 when image formation is enabled, i.e., when the cover 50 is closed. Consequently, even if rotational position of the lock lever 70 is shifted due to dimension tolerances of components such as the lock lever 70 and guide member 54, the secondary transfer unit 60 is not displaced with respect to the main body 10.

Figure 2:
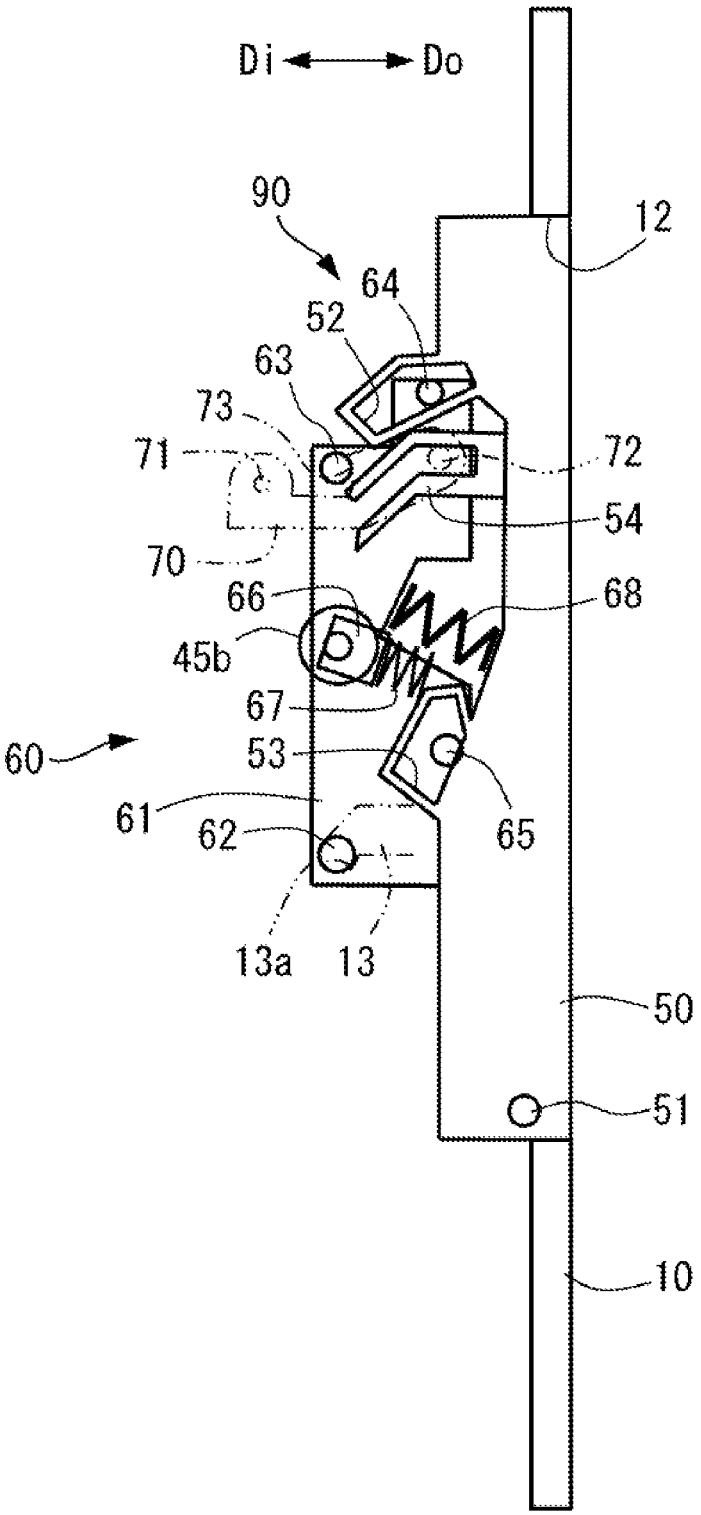
FIG. 2 is a sectional view showing a schematic configuration with a cover and secondary transfer unit according to the first embodiment closed.

With the second engaging pin 65 rotating in the direction of arrow R2 by being pushed by the biasing spring 68, the secondary transfer unit 60 is pushed to a position at which it is locked by the lock lever 70. Then, as shown in FIG. 2, the secondary transfer unit 60 is fixed to the main body 10 by the lock lever 70 subjected to a turning force by the guiding groove of the guide member 54. That is, with the cover 50 closed (with the secondary transfer outer roller 45*b* abutted against the intermediate transfer belt 44*b*), the locking portion 73 of the lock lever 70 abuts the locating pin 63 and the secondary transfer unit 60 is positioned with respect to the main body 10.

On the other hand, when the user opens the cover 50, for example, for jam clearance, the user starts turning the cover 50 in an opening direction as shown in FIGS. 2 and 3. Along with the opening operation, a rotating force is transmitted to the lock lever 70 via the guiding groove of the guide member 54, turning the lock lever 70 in the direction of arrow R3 around the rotary shaft 71. Consequently, the locating pin 63 of the secondary transfer unit 60 is released from the locking portion 73 of the lock lever 70 and the lock lever 70 is unlocked. When the lock lever 70 is unlocked, the secondary transfer unit 60 turns in the direction of arrow R4 around the engaging grooves 13 by a reaction force of the intermediate transfer belt 44*b*. Subsequently, the first engaging pin 64 of the secondary transfer unit 60 moves by being pushed by the first restraining portion 52 on the cover 50, disengaging the rotational engaging portion 62 of the secondary transfer unit 60 from the engaging groove 13, and consequently the secondary transfer unit 60 turns together with the cover 50, changing its state from the state shown in FIG. 4 to the state shown in FIG. 5. Consequently, a sheet conveyance route opens widely in the opening portion 12, making jam clearance and the like easier to carry out.

Next, the operation of taking the intermediate transfer unit 44 out of the main body 10 will be described. When the life of the intermediate transfer belt 44*b* is shorter than the life of the main body 10, it is necessary to replace the intermediate transfer belt 44*b* periodically. The replacement of the intermediate transfer belt 44*b* is carried out by removing the intermediate transfer unit 44, with the intermediate transfer belt 44*b* mounted thereon, from the main body 10. Desirably, the intermediate transfer unit 44 is attached and detached to/from the main body 10 from the side of the cover 50. For example, if the intermediate transfer unit 44 is configured to be attached and detached from the near side of the main body 10, a large opening has to be provided on the near side of the main body 10 to allow the intermediate transfer unit 44 to be removed. If such a large opening is provided, rigidity of the main body 10 may be impaired. On the side of the cover 50, since the opening portion 12 for contact with the secondary transfer outer roller 45*b* has to be provided, there is no need to provide an opening solely for the purpose of installing and removing the intermediate transfer unit 44.

Figure 6:
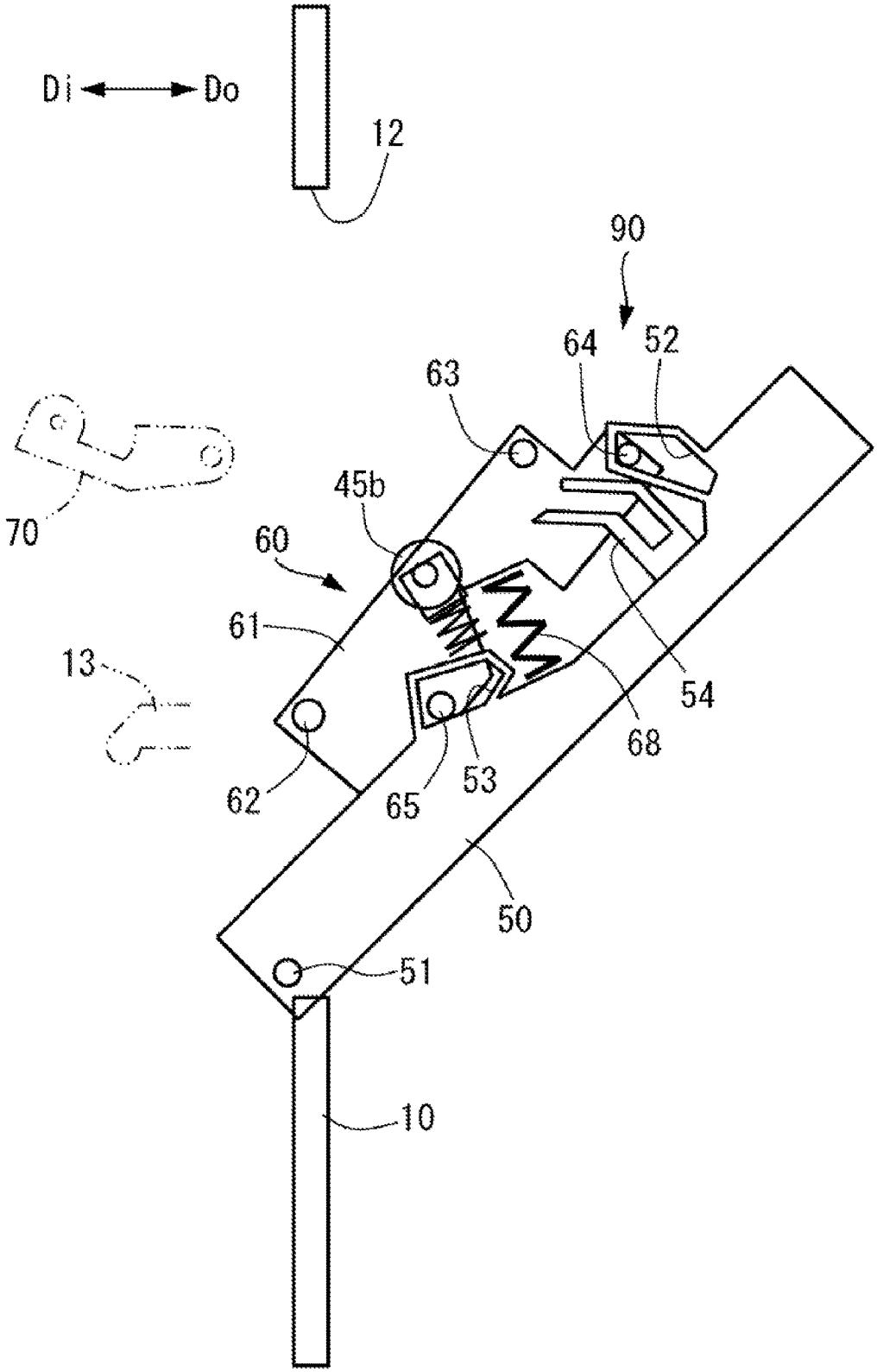
FIG. 6 is a sectional view showing a schematic configuration with the cover and secondary transfer unit according to the first embodiment opened slightly from the first inclined position.

Beginning with the state shown in FIG. 5 and passing through the state shown in FIG. 6, the cover 50 is opened as shown in FIG. 7. At this time, the cover 50 is open to the maximum and the first engaging pin 64 of the secondary transfer unit 60 is drawn toward that side of the first restraining portion 52 which is closer to the cover 50. Also, the secondary transfer unit 60 is rotated in the direction of arrow R5 around the first engaging pin 64 by the biasing spring 68. Consequently, the second engaging pin 65 abuts the second restraining portion 53, maintaining a posture of the secondary transfer unit 60. In this state, the secondary transfer unit 60 is positioned closest to the cover 50 (second relative position). Also, this state secures enough space in pulling out the intermediate transfer unit 44.

Now, let F0 denote a force of gravity tending to move the secondary transfer unit 60 downward due to self-weight. The cover 50 receives the biasing spring 68 on a bearing surface. A center-of-gravity position of the secondary transfer unit 60 is located to the right of the bearing surface in FIG. 7 and the resultant force F3 of the force of gravity F0 causing the secondary transfer unit 60 to move downward under its self-weight and the biasing force 01 of the biasing spring 68 acts on the secondary transfer unit 60. If the force of gravity F0 acting on the weight of the secondary transfer unit 60 is larger than the biasing force F1 of the biasing spring 68, the resultant force F3 acting on the secondary transfer unit 60 points in a lower right direction, tending to move the secondary transfer unit 60 in the lower right direction. This enables drawing the secondary transfer unit 60 toward the cover 50 when the intermediate transfer unit 44 is pulled out.

On the other hand, as shown in FIG. 5, when the cover 50 is being closed, the resultant force F2 of the force of gravity F0 causing downward movement of the secondary transfer unit 60 under self-weight and the biasing force F1 of the biasing spring 68 acts in the lower left direction. If the force of gravity F0 acting on the weight of the secondary transfer unit 60 is larger than the biasing force F1 of the biasing spring 68, the secondary transfer unit 60 tends to move in the lower left direction. This causes the rotational engaging portion 62 of the secondary transfer unit 60 to protrude from the cover 50 when the cover 50 is being closed, and thereby allows the rotational engaging portion 62 to get engaged with the engaging groove 13 in the main body 10 earlier.

As shown in FIG. 7, the intermediate transfer unit 44 is pulled out along the guiding rail 14 provided in the main body 10 substantially horizontally to the outward direction Do. The intermediate transfer unit 44 can be pulled out without interfering with the secondary transfer unit 60 even when fully pulled out. If the secondary transfer unit 60 is protruding from the cover 50 (located at the first relative position), the intermediate transfer belt 44*b* might be damaged, which might cause various types of image defect. Also, if one attempts to secure space for inserting and withdrawing the intermediate transfer unit 44 even with the secondary transfer unit 60 protruding, it becomes necessary to move the rotary shaft 51 of the cover 50 to lower part of the main body 10, resulting in an increase in the size of the cover 50. The increase in the size of the cover 50 might make it necessary to secure extra space for opening the cover 50 when the image forming apparatus 1 is provided.

As described above, with the image forming apparatus 1 according to the present embodiment, when the cover 50 is located in the second inclined position, if the secondary transfer unit 60 is located at the first relative position with respect to the cover 50, the secondary transfer unit 60 interferes with the intermediate transfer unit 44 located in the pulled-out position. Also, when the cover 50 is located in the second inclined position, if the secondary transfer unit 60 is located at the second relative position with respect to the cover 50, the secondary transfer unit 60 does not interfere with the intermediate transfer unit 44 located in the pulled-out position. Also, according to the present embodiment, if the secondary transfer unit 60 is located at the third relative position with respect to the cover 50, the secondary transfer unit 60 is positioned to interfere with the intermediate transfer unit 44 located in the pulled-out position. This enables preventing interference with the secondary transfer unit 60 in attaching and detaching the intermediate transfer unit 44 by opening the cover 50, and limiting increases in the size of the cover 50. Note that whereas in the present embodiment, whether the position of the secondary transfer unit 60 relative the cover 50 may be the first relative position or third relative position, the secondary transfer unit 60 is positioned to interfere with the intermediate transfer unit 44 located in the pulled-out position, this is not restrictive. Size increases of the cover 50 can be limited as long as the secondary transfer unit 60 has such a positional relationship with the intermediate transfer unit 44 located in the pulled-out position as to cause interference in at least one of two cases: when the relative position is the first relative position and when the relative position is the third relative position.

Also, with the image forming apparatus 1 according to the present embodiment, when the cover 50 is in the first inclined position, the switching portion 90 can place the secondary transfer unit 60 at the first relative position protruding from the cover 50. Also, when the cover 50 is in the second inclined position, the switching portion 90 can place the secondary transfer unit 60 at the second relative position closer to the cover 50. Therefore, when the cover 50 is opened and placed in the second inclined position, since the secondary transfer unit 60 is located at the second relative position, the intermediate transfer unit 44 can be attached and detached without interfering with the secondary transfer unit 60. Thus, when the intermediate transfer unit 44 is attached and detached to/from the main body 10 by opening the cover 50, the intermediate transfer unit 44 to be pulled out does not interfere with the secondary transfer unit 60 protruding upward from the opened cover 50. This eliminates the need to establish a rotation center of the cover 50 in the lower part of the main body 10 and enables limiting size increases of the cover 50 while allowing the intermediate transfer unit 44 to be attached and detached when the cover 50 is opened. That is, when the cover 50 holding the secondary transfer unit 60 is opened, the secondary transfer unit 60 moves toward the cover 50. Consequently, space for inserting and withdrawing the intermediate transfer unit 44 can be secured without increasing the size of the cover 50. This provides the image forming apparatus 1 with reduced installation space and increased replaceability of replacement parts.

Also, with the image forming apparatus 1 according to the present embodiment, the secondary transfer unit 60 is supported movably with respect to the cover 50. Then, after the rotational engaging portion 62 of the secondary transfer unit 60 is engaged with the engaging groove 13, when the cover 50 is further closed, the secondary transfer unit 60 rotates around the rotational engaging portion 62 and the secondary transfer outer roller 45*b* is locked in a state of being pressed against the secondary transfer inner roller 45*a*. That is, the secondary transfer outer roller 45*b* and secondary transfer unit 60 have a first turning state of turning around the rotary shaft 51 of the cover 50 along with opening and closing operation of the cover 50 and a second turning state of turning around the engaging groove 13 provided in the main body 10. Thus, the image forming apparatus 1 provided by the present embodiment gives the user high visibility and great ease of operation, lends itself to being accurately positioned with respect to the main body 10 using the lock lever 70, requires a small operating force of the user to open and close the cover 50, and allows a sheet conveyance route to be opened widely when the cover 50 is opened. This reduces the operating force needed to open and close the cover 50 and makes jam clearance easier.

Now, the reason why the user's operating force required to open and close the cover 50 is reduced in the present embodiment will be described briefly. In addition to the secondary transfer outer roller 45*b*, plural conveyance rollers (not shown) needed to convey the sheets S are rotatably mounted on the cover 50. Along with closing operation of the cover 50, the plural conveyance rollers are paired with conveyance rollers on the side of the main body, forming nips. Then, as described above, the secondary transfer unit 60 turns, out of phase with the cover 50. This allows nip formation timing of the secondary transfer outer roller 45*b* and the secondary transfer inner roller 45*a* to be shifted from nip formation timing of the plural conveyance rollers and the conveyance rollers on the side of the main body. This enables reducing the user's operating force of the cover 50.

Note that although in the image forming apparatus 1 according to the present embodiment described above, a compression coil spring is used as the biasing spring 68, this is not restrictive. For example, a torsion coil spring may be used as the biasing spring 68. Also, although in the image forming apparatus 1 according to the present embodiment described above, the engaging groove 13 is used as a third engaging portion, this is not restrictive. For example, the third engaging portion may be configured to do positioning using a main body positioning member provided on the main body 10 and shaped to pinch the locating pin 63 from above and below. The main body positioning member is made up of components having sufficient strength and meeting an overall positioning standard of the image forming apparatus 1, such as frames forming a skeleton of the main body 10 and components configured to support the intermediate transfer unit 44 and do positioning.

Figure 10:
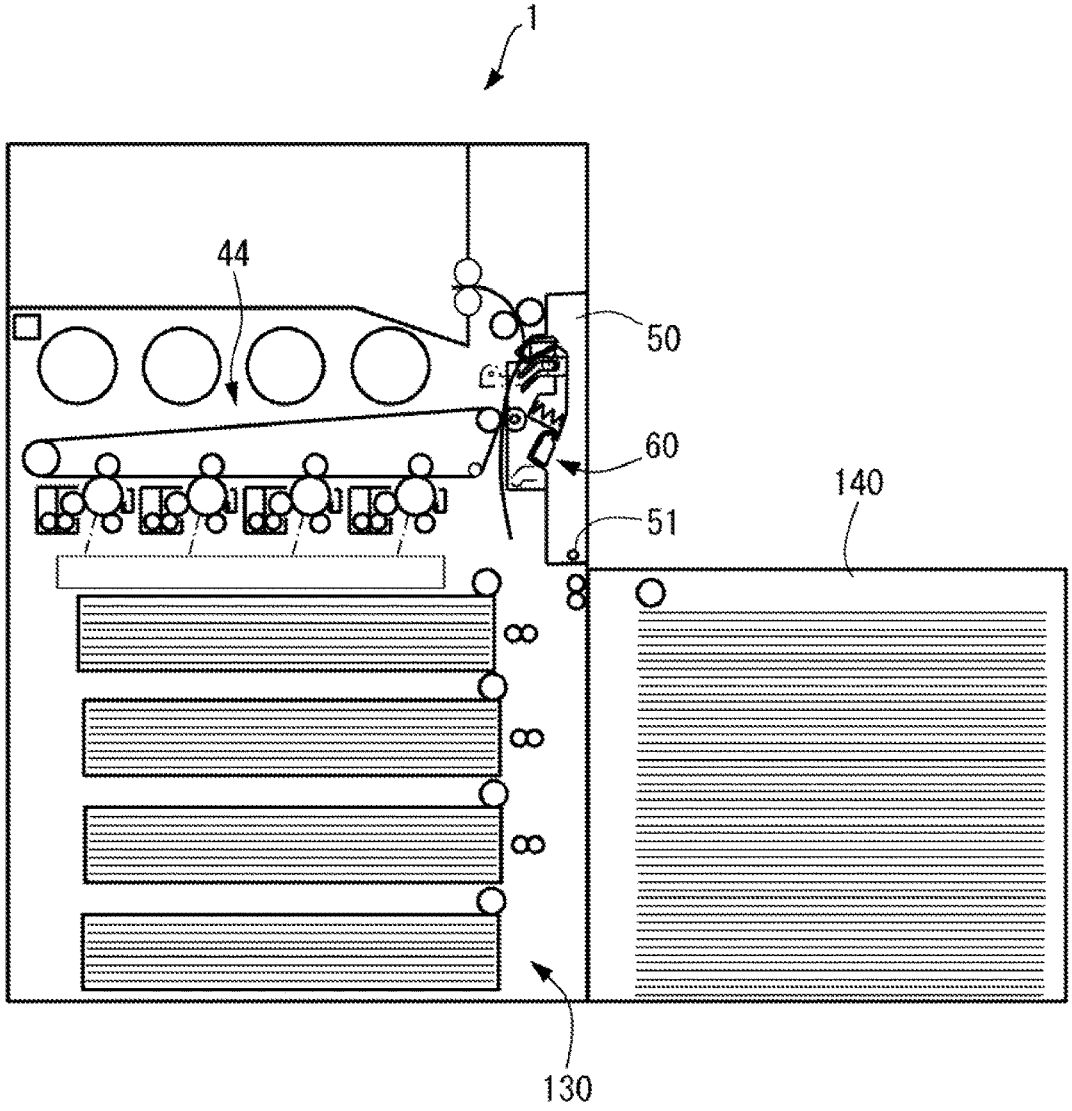
FIG. 10 is a sectional view showing a schematic configuration of a variation of the image forming apparatus according to the first embodiment.

Also, although in the image forming apparatus 1 according to the present embodiment described above, the sheet feeding portion 30 has only one sheet cassette 31, this is not restrictive. For example, as shown in FIG. 10, a sheet feeding portion 130 having plural sheet cassettes or an external feeder 140 may be provided. In the latter case, the external feeder 140 is provided on the sheet conveyance path side of the image forming apparatus 1. Here, if the cover 50 is located in the second inclined position and the secondary transfer unit 60 is located at the first relative position, protruding from the cover 50, the position of the rotary shaft 51 has to be moved down the main body 10. Then, the rotary shaft 51 becomes lower than a top surface of the external feeder 140, and consequently the rotary shaft 51 will interfere with the external feeder 140 when the cover 50 is opened and closed. In this case, before opening the cover 50, the external feeder 140 needs to be spaced away from the main body 10, and thus the cover 50 can be opened only after the external feeder 140 is spaced away. In contrast, with the image forming apparatus 1 according to the present embodiment, when the cover 50 is located in the second inclined position, since the secondary transfer unit 60 is located at the second relative position closer to the cover 50, there is no need to move the position of the rotary shaft 51 down the main body. Consequently, this enables avoiding interference between the opening and closing cover 50 and the external feeder 140.

Also, although in the image forming apparatus 1 according to the present embodiment described above, the pressure roller 46*b* is provided in the main body 10, this is not restrictive. For example, the pressure roller 46*b* may be provided in the secondary transfer unit 60.

Also, although in the present embodiment, the first engaging pin (restraining portion) 64 is provided as a first engaging portion in the secondary transfer unit 60 and the first restraining portion 52 is provided on the cover 50 as a second engaging portion configured to get engaged with the first engaging pin, this is not restrictive. For example, the first restraining portion 52 may be provided in the secondary transfer unit 60 while installing the first engaging pin (restraining portion) 64 on the cover 50.

Second Embodiment

Next, a second embodiment of the present invention will be described in detail with reference to FIGS. 11A and 11B. The present embodiment differs in configuration from the first embodiment in that a switching portion 190 does not have a biasing spring. However, other components are similar to that of the first embodiment, and thus denoted by the same reference numerals as the corresponding components of the first embodiment, and detailed description thereof will be omitted.

According to the present embodiment, the switching portion 190 includes a first engaging pin (guided portion) 64 provided in the secondary transfer unit 60, a second engaging pin (guided portion) 65, and a first guiding portion 152 and a second guiding portion 153 provided on the cover 50. The first guiding portion (guiding portion) 152 can guide the first engaging pin 64 by self-weight of the secondary transfer unit 60 and the second guiding portion (guiding portion) 153 can guide the second engaging pin 65 by self-weight of the secondary transfer unit 60.

The first guiding portion 152 is made up of a hole bent in a central portion and inclined so as to be lower in the inward direction Di and higher in the outward direction Do when the cover 50 is located in the closed position. The first guiding portion 152 includes a first guiding portion 152*a* and a second guiding portion 152*b*. The first guiding portion 152*a* guides the first engaging pin 64 to place the secondary transfer unit 60 at the first relative position when the cover 50 is located in the first inclined position (see FIG. 11A). The second guiding portion 152*b* is provided continuously with the first guiding portion 152*a* and configured to guide the first engaging pin 64 to place the secondary transfer unit 60 at the second relative position when the cover 50 is located in the second inclined position (see FIG. 11B).

The second guiding portion 153 is made up of a hole bent in a central portion and inclined so as to be lower in the inward direction Di and higher in the outward direction Do when the cover 50 is located in the closed position. The second guiding portion 153 includes a first guiding portion 153*a* and a second guiding portion 153*b*. The first guiding portion 153*a* guides the second engaging pin 65 to place the secondary transfer unit 60 at the first relative position when the cover 50 is located in the first inclined position (see FIG. 11A). The second guiding portion 153*b* is provided continuously with the first guiding portion 153*a* and configured to guide the second engaging pin 65 to place the secondary transfer unit 60 at the second relative position when the cover 50 is located in the second inclined position (see FIG. 11B).

Figure 11A:
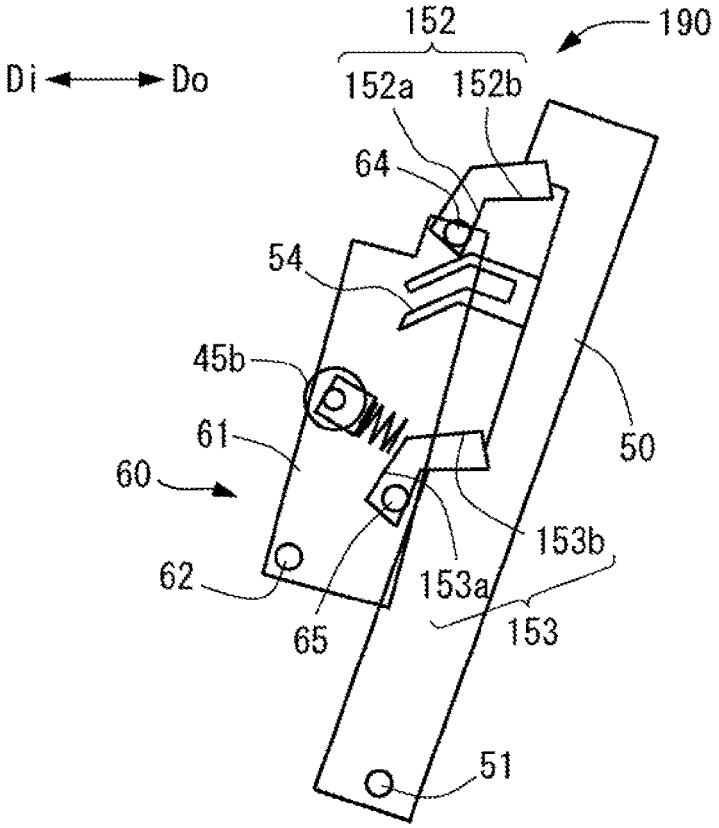
FIG. 11A is a sectional view showing how a cover and secondary transfer unit according to a second embodiment are located in a first inclined position.
Figure 11B:
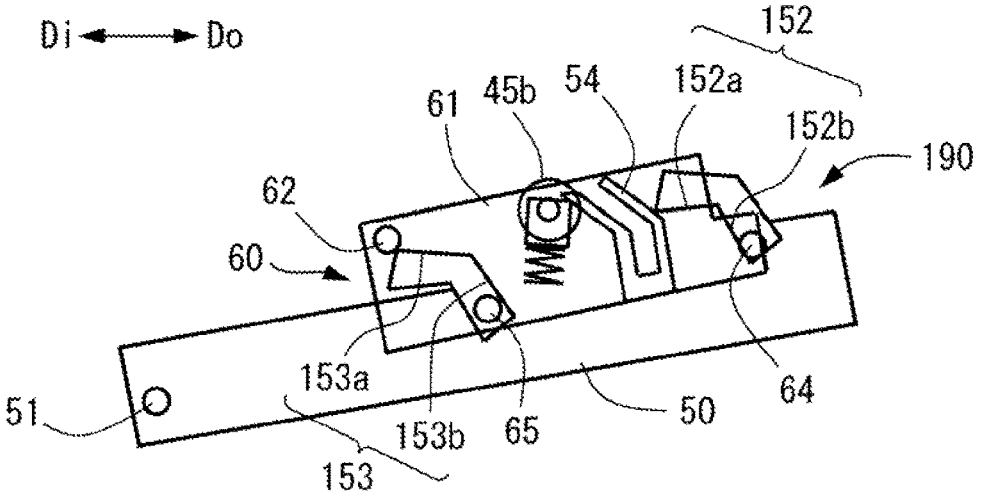
FIG. 11B is a sectional view showing how the cover and secondary transfer unit according to a second embodiment are opened to a second inclined position.

As shown in FIG. 11A, when the cover 50 is slightly open and located in the first inclined position, the first engaging pin 64 of the secondary transfer unit 60 is guided by the first guiding portion 152*a* and the second engaging pin 65 is guided by the first guiding portion 153*a*. Consequently, the secondary transfer unit 60 is held protruding from the cover 50. When the cover 50 is opened gradually in this state, as shown in FIG. 11B, the first engaging pin 64 of the secondary transfer unit 60 is guided by the second guiding portion 152*b* and the second engaging pin 65 is guided by the second guiding portion 153*b*. Consequently, the secondary transfer unit 60 is drawn closest to the cover 50. Thus, space for inserting and withdrawing the intermediate transfer unit 44 can be secured.

As described above, also with the present embodiment, when the intermediate transfer unit 44 is attached and detached to/from the main body 10 by opening the cover 50, the intermediate transfer unit 44 to be pulled out does not interfere with the secondary transfer unit 60 protruding upward from the opened cover 50. This eliminates the need to establish a rotation center of the cover 50 in the lower part of the main body 10 and enables limiting size increases of the cover 50 while allowing the intermediate transfer unit 44 to be attached and detached when the cover 50 is opened.

Also, with the image forming apparatus 1 according to the present embodiment, since the switching portion 190 does not use a biasing spring, increases in the number of parts can be suppressed.

According to the present invention, when the cover is located in the open position, the cover-side unit interferes with the intermediate transfer unit located in the pulled-out position in at least one of two cases: if the relative position of the cover-side unit is the first relative position and if the relative position of the cover-side unit is the third relative position. Also, when the cover is located in the open position, if the relative position of the cover-side unit is the second relative position, the cover-side unit does not interfere with the intermediate transfer unit located in the pulled-out position. This enables preventing interference with the secondary transfer unit in attaching and detaching the intermediate transfer unit by opening the cover and suppresses increases in the size of the cover.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-166165 filed Aug. 30, 2017, which is hereby incorporated by reference herein in its entirety.

What is claimed is:

1. An image forming apparatus, comprising:

a main body;

an opening portion provided in a side surface of the main body;

a cover pivotally provided on the main body and configured to be pivotal between a closed position in which the opening portion is closed and an open position in which the opening portion is opened, an upper part of the cover being openable outward and closable around a rotary shaft provided in a lower part of the cover;

an intermediate transfer unit provided in the main body so as to be detachable and mountable through the opening portion and provided with an intermediate transfer belt to which a toner image is transferred;

a secondary transfer unit movably supported with respect to the cover and provided with a transfer member configured to transfer the toner image transferred to the intermediate transfer belt to a recording material;

a guiding portion provided in the main body and configured to guide the intermediate transfer unit, the guiding portion being configured to guide the intermediate transfer unit from a first position in which the intermediate transfer unit becomes removable from the main body to a second position in which the intermediate transfer unit is mounted in the main body, the guiding portion being configured to support the intermediate transfer unit in the first position;

a first engaging portion provided on the secondary transfer unit; and a second engaging portion provided on the cover so as to be engageable with the first engaging portion and configured to limit movement of the secondary transfer unit relative to the cover to a predetermined range by being engaged with the first engaging portion, wherein when the cover is moved from an intermediate position between the closed position and the open position to the open position, a relative position of the secondary transfer unit with respect to the cover is changed by using a self-weight of the secondary transfer unit from a first relative position to a second relative position, and wherein when the cover is located in the open position and the intermediate transfer unit is supported in the first position by the guiding portion, the secondary transfer unit interferes with the intermediate transfer unit if located in the first relative position, but does not interfere with the intermediate transfer unit if located in the second relative position.

2. The image forming apparatus according to claim 1, further comprising a biasing unit provided between the secondary transfer unit and the cover and configured to bias the secondary transfer unit, wherein when the cover is located in the open position, the relative position of the secondary transfer unit with respect to the cover is located in the second relative position by a resultant force of the self-weight of the secondary transfer unit and a biasing force of the biasing unit, and wherein when the cover is located in the intermediate position, the relative position of the secondary transfer unit with respect to the cover is located in the first relative position by the resultant force of the self-weight of the secondary transfer unit and the biasing force of the biasing unit.

3. The image forming apparatus according to claim 1, further comprising:

a guided portion provided in the secondary transfer unit; and a guide portion provided on the cover and configured to guide the guided portion by the self-weight of the secondary transfer unit;

wherein the guide portion includes a first guiding portion configured to guide the guided portion so as to locate the relative position of the secondary transfer unit with respect to the cover in the first relative position when the cover is located in the intermediate position, and a second guiding portion provided continuously with the first guiding portion and configured to guide the guided portion so as to locate the relative position of the secondary transfer unit with respect to the cover in the second relative position when the cover is located in the open position.

4. The image forming apparatus according to claim 1, further comprising:

a third engaging portion provided in the main body; and a fourth engaging portion provided in a lower part of the secondary transfer unit so as to be engageable with the third engaging portion, the fourth engaging portion being engaged with the third engaging portion when the cover is closed, an engagement of the fourth engaging portion with the third engaging portion rotatably supports the secondary transfer unit, the fourth engaging portion being spaced away from the third engaging portion when the cover is opened.

5. The image forming apparatus according to claim 1, further comprising a biasing portion provided in the secondary transfer unit and configured to bias the transfer member to the intermediate transfer belt when the cover is located in the closed position.

6. The image forming apparatus according to claim 1, further comprising:

a lock lever portion pivotally provided on the main body and configured to fix the secondary transfer unit to the main body when the cover is closed; and a guide portion provided on the cover and configured to guide the lock lever portion to a lock position and an unlock position in association with movement of the cover.

7. The image forming apparatus according to claim 1, wherein a resultant force of forces acting on the secondary transfer unit is oriented in a downward and inward direction of the main body when the cover is located in the intermediate position and the resultant force of forces acting on the secondary transfer unit is oriented in a downward and outward direction of the main body when the cover is located in the open position.

8. The image forming apparatus according to claim 1, further comprising a feeder located outside the main body, facing a side surface on which the cover is provided and configured to feed the recording material to the main body, wherein the rotary shaft is located above a top surface of the feeder.

9. An image forming apparatus, comprising:

a main body;

an opening portion provided in a side surface of the main body;

a cover pivotally provided on the main body and configured to be pivotal between a closed position in which the opening portion is closed and an open position in which the opening portion is opened, an upper part of the cover being openable outward and closable around a rotary shaft provided in a lower part of the cover;

an intermediate transfer unit provided in the main body so as to be detachable and mountable through the opening portion and provided with an intermediate transfer belt to which a toner image is transferred;

a secondary transfer unit movably supported with respect to the cover and provided with a transfer member configured to transfer the toner image transferred to the intermediate transfer belt to a recording material;

a feeder located outside the main body, facing a side surface on which the cover is provided and configured to feed the recording material to the main body;

a first engaging portion provided on the secondary transfer unit; and a second engaging portion provided on the cover so as to be engageable with the first engaging portion and configured to limit movement of the secondary transfer unit relative to the cover to a predetermined range by being engaged with the first engaging portion, wherein the rotary shaft is located above a top surface of the feeder, the cover is movable to the open position when the feeder is located in a feeding position in which the feeder is located to feed the recording material to the main body, wherein when the cover is moved from an intermediate position between the closed position and the open position to the open position, a relative position of the secondary transfer unit with respect to the cover is changed by using a self-weight of the secondary transfer unit from a first relative position to a second relative position, and wherein when the cover is located in the open position, a height of the secondary transfer unit is a first height if the relative position is located in the first relative position and the height of the secondary transfer unit is a second height lower than the first height if the relative position is located in the second relative position.

10. The image forming apparatus according to claim 9, wherein the intermediate transfer unit is detachable from and mountable to the main body with the cover being located in the open position.

* * * * *